US007517113B2

(12) United States Patent
Bruckner

(10) Patent No.: US 7,517,113 B2
(45) Date of Patent: Apr. 14, 2009

(54) GRID SCREEN FOR ILLUMINATION DEVICES

(76) Inventor: Attila Bruckner, Schönborner Strasse 9, D-56370 Wasenbach (DE)

( * ) Notice: Subject to any disclaimer, the term of this patent is extended or adjusted under 35 U.S.C. 154(b) by 58 days.

(21) Appl. No.: 11/539,988

(22) Filed: Oct. 10, 2006

(65) Prior Publication Data

US 2008/0055907 A1 Mar. 6, 2008

(30) Foreign Application Priority Data

Sep. 5, 2006 (EP) ..... 06076685

(51) Int. Cl.
*F21V 11/06* (2006.01)

(52) U.S. Cl. ..... 362/290; 362/279; 362/354

(58) Field of Classification Search ..... 362/290, 362/279, 277, 342, 368, 255, 440, 292, 444, 362/291, 358, 354, 539
See application file for complete search history.

(56) References Cited

U.S. PATENT DOCUMENTS

| | | | | |
|---|---|---|---|---|
| 3,919,543 | A * | 11/1975 | Noren | 362/293 |
| 4,516,197 | A * | 5/1985 | Yonkers | 362/342 |
| 4,772,097 | A * | 9/1988 | Takeuchi et al. | 359/894 |
| 5,287,258 | A * | 2/1994 | Remus | 362/256 |
| 6,629,771 | B2 * | 10/2003 | Chiu | 362/368 |

FOREIGN PATENT DOCUMENTS

| | | | |
|---|---|---|---|
| DE | 295 01 521 | U1 | 4/1995 |
| DE | 29505546 | U1 | 9/1995 |
| DE | 101 18 783 | A1 | 10/2002 |
| DE | 20306703 | U1 | 9/2003 |
| EP | 0819232 | B1 | 11/1998 |
| EP | 1156269 | B1 | 2/2006 |
| FR | 2590652 | A1 | 5/1987 |
| GB | 633 090 | A | 12/1949 |

* cited by examiner

*Primary Examiner*—Jong-Suk (James) Lee
*Assistant Examiner*—Leah S Lovell
(74) *Attorney, Agent, or Firm*—Norris McLaughlin & Marcus, PA; Christa Hildebrand

(57) ABSTRACT

A grid screen for an illumination device includes a honeycomb grid disc (5) mounted in a component (4) having an aperture (9). The grid screen is fastened to the component with spring clips (10). The spring clips (10) have cranked clip ends (11), which are directed towards the middle and rotated by 90°, so as to pass through the aperture (9) of the honeycomb grid disc (5) and hook under a bridge (3) of the illumination device. Keyhole-type cutouts (8) on both sides of the aperture (9) are positioned over the bridge (3) in a contactless manner. The deeply situated annular honeycomb grid disc (5) absorbs the glare rays (12) emerging from underneath a cap (2), while reflected useful rays (15) are passed through the honeycomb grid disc (5).

6 Claims, 3 Drawing Sheets

GRID SCREEN FOR ILLUMINATION DEVICES

BACKGROUND OF THE INVENTION

1. Field of the Invention

The invention relates to a grid screen for illumination devices comprising a honeycomb grid disc grid screen for illumination devices, the illumination device comprising a reflector lamp including a bridge and a centrally arranged cap. The grid screen includes a peripheral component with an inserted honeycomb grid disc, lower and upper disc holders and grid screen fastening means.

2. Description of Related Art

Various grid screens are known which are attached directly on the luminous-body housing at a measured distance from the light source, in particular strip lights.

EP 0 819 232 B1 discloses an adapter for freely radiating miniature reflectors, in which a support element with light-directing components, for example ribs, is arranged on the reflector rim and is fastened underneath the reflector rim in an interlocking manner by means of clamping elements. This adapter is suitable for standardized illumination devices having a bridge and anti-glare caps only if the lower reflector rim is accessible and not obstructed. This solution is not suitable for relatively large illumination units.

According to DE 203 06 703 U1 there is known for an illumination device having a bridge and an anti-glare cap a fastening clamp which fastens a sheet-like body to the bridge by means of clamps. The sheet-like body is provided in its middle with a fastening means for filter discs. The interlocking and thus not sufficiently firm connection of the sheet-like body to the bridge of the illumination device is disadvantageous in this embodiment. The distance from the fastened filter to the light source and the anti-glare cap is such that light emerging at the sides underneath the anti-glare cap can dazzle the observer. The known embodiment according to EP 1 156 269 B1 has said disadvantage as well.

An illumination device is known according to DE 295 01 521 U1 in which an apparatus for fastening the filter disc is already arranged directly on the rim of the reflector. The peripheral component comprises non-elastic, but flexible material and is connected to the rim of the reflector in an interlocking manner. This component encloses the filter disc and spaces the disc apart from the light source. The interlocking fastening underneath the reflector ring by means of reflector holding claws is disadvantageous in this embodiment of the holding and spacer ring. In each case, the reflector claws need to be adapted corresponding to the formation of the lower rim of the reflector ring. In most known luminaries, the lower rim region is obstructed by further structural elements and no longer accessible for reflector claws. In principle, the disadvantage transpires that in reflector lamps without lower rims, or with only rudimentary lower rims or with covered lower rims, the reflector claws can only be adapted to the reflector ring with difficulty. Furthermore, loose fastening cannot be ruled out in the case of fastening by means of claws, and even lift-off of the reflector ring cannot be ruled out if a relatively strong force is applied. This known holding apparatus is suitable for holding honeycomb grid discs, but has the disadvantage that it cannot be applied in standardized illumination devices having a bridge projecting over the reflector rim and an anti-glare cap, because the cap and the bridge project beyond the rim of the reflector in these devices.

On account of their design, the fitted screens of the known illumination devices have the disadvantage of a relatively large distance to the luminous body, the result being that lateral emissions are not avoided. These lateral emissions have also not been eliminated with the known solutions for illumination devices having standardized bridges and anti-glare caps. The rays emerging at the sides underneath the centrally arranged cap can emerge unimpeded underneath the screens.

SUMMARY OF THE INVENTION

The object of the invention is to provide a secure holding means of the honeycomb grid disc and a fastening means of the grid screen for a plurality of standardized illumination devices, which fastening means is connected to the rim of the reflector lamp in a force-fitting manner and simultaneously holds a honeycomb disc in an interlocking manner, and wherein the grid screen is at the same time designed such that arrangement of the honeycomb grid disc is possible despite a highly situated bridge, and thus disturbing lateral emissions are reduced or completely avoided.

The invention is particularly suitable for all reflector lamps with standardized rim formation, such as the aluminium reflector lamp 111 mm. The only measurement for the adaptation is the diameter of the upper reflector rim.

This object is achieved according to the invention by means of the features of the patent claim, that is to say that the honeycomb grid disc of the grid screen is provided with a punched-out aperture and the grid screen fastening means comprises spring clips which are fixedly connected on both sides in each case by one side to the peripheral component and whose cranked clip ends, which are directed towards the middle, reach through the punched-out middle aperture of the honeycomb grid disc and hook under the bridge of the illumination device, and the grid screen presses onto the rim of the reflector lamp, wherein the keyhole-type cutouts on both sides are arranged slipped over the bridge such that the deeply situated honeycomb grid disc absorbs the scattered light emerging from the sides underneath the cap.

BRIEF DESCRIPTION OF THE DRAWING

An exemplary embodiment of the invention will be explained in detail with reference to the drawings.

In the drawings.

DETAILED DESCRIPTION OF THE INVENTION

Figure 1:
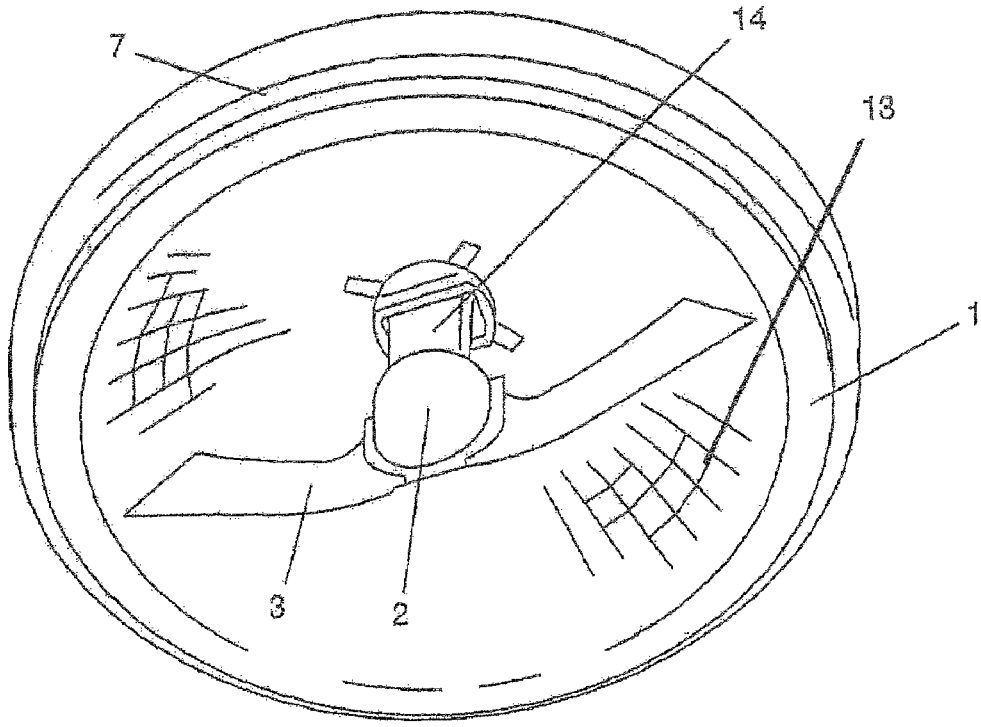
FIG. 1 shows the illustration of a standardized illumination device.

According to FIG. 1, the known illumination unit comprises a reflector lamp 1 having a bridge 3 fixedly arranged on the reflector 13. An anti-glare cap 2 is fastened centrally on the bridge 3. A light source 14 has an upper portion which projects into the cap 2. The outer upper rim 7 of the reflector lamp 1 is standardized in terms of structural dimensions and classifications, as are the bridge 3 and the cap 2. The upper rim 7 of the reflector lamp 1 forms an annular step-like shoulder which also projects out of the structure when the reflector lamp 1 is installed.

Figure 2:
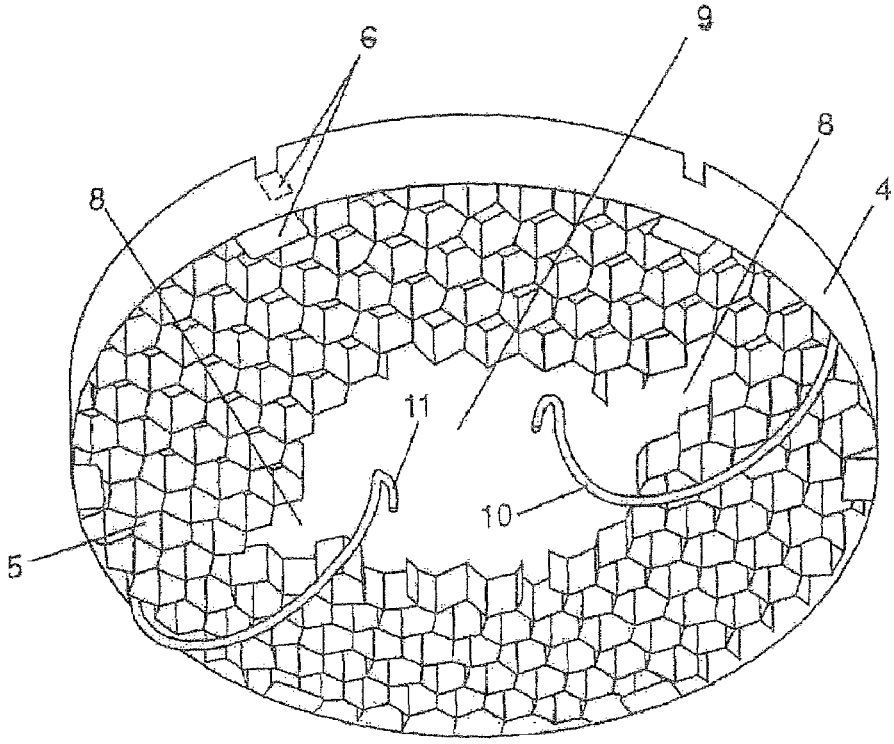
FIG. 2 shows the grid screen in the assembled complex.
Figure 3:
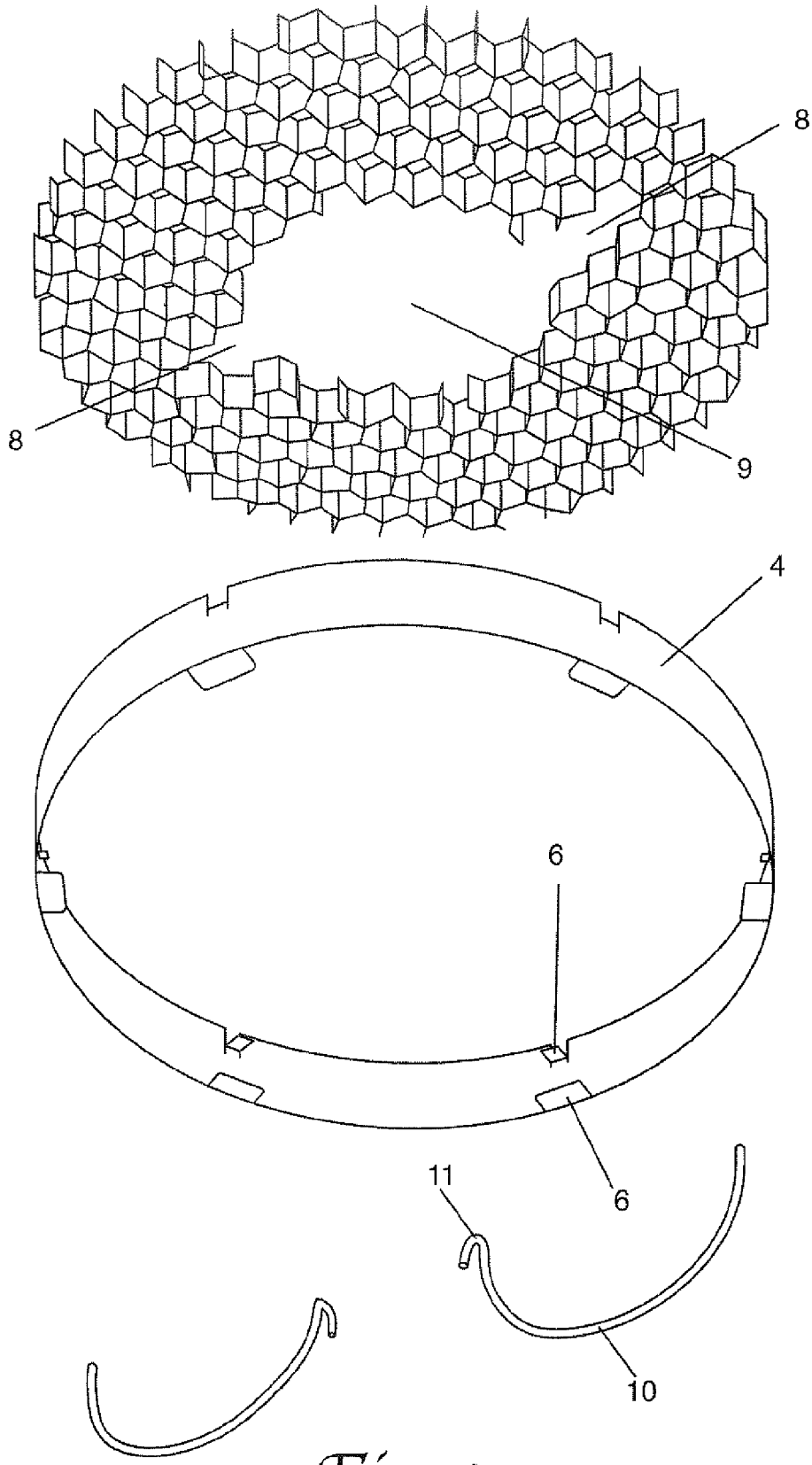
FIG. 3 shows the grid screen in an exploded view.
Figure 4:
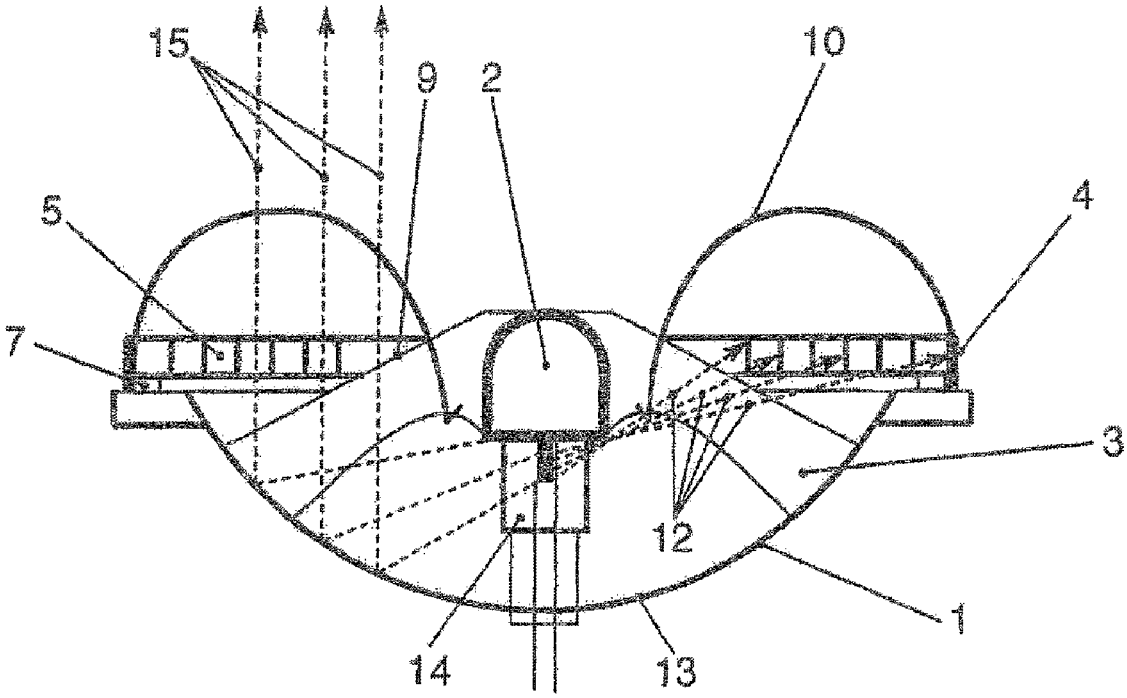
FIG. 4 shows a sketch of the prevented lateral emission.

The grid screen according to FIGS. 2, 3 and 4 comprises a peripheral component 4 having upper and lower disc holders 6. In the angled-away state, the disc holders 6 space apart a honeycomb grid disc 5 inserted therebetween. Spring clips 10 for fastening the grid screen are provided on the peripheral component 4. The spring clips 10 are fixedly attached to the peripheral component 4 and are cranked towards the middle as clip ends 11 and rotated by 90°. The fixed arrangement of the spring clips 10 on the component 4 is effected advantageously by spot-welding. For this purpose, the ends of the spring clips 10 are formed into lugs (not illustrated in the drawing). A centric aperture 9 having keyhole-type cutouts 8 at the sides is punched out in the honeycomb grid disc 5. The grid screen is formed as an inherently compact device in the mounted state.

Only the dimensions of the diameter of the step-like rim 7 need to be adhered to in the formation of the component 4 in order to form a finished unit with the customary reflector lamp 1. The aperture 9, the keyhole-type cutouts 8 and the spring clips 10 have diameter-dependent measurements and can be prefabricated completely for any desired diameters of the reflector lamps 1.

The grid screen adapted to the diameter of the reflector lamp 1 is fitted on the step-like rim 7 of the reflector lamp 1 and fastened in a manner such that the keyhole-type cutouts 8 of the honeycomb grid disc 5 are in each case positioned over the bridge 3 which projects into the honeycomb grid disc 5. The spring clips 10 projecting into the punched-out aperture 9 are manually hooked under the bridge 3 of the reflector lamp 1 by their cranked clip ends 11. This completes the mounting of the grid screen. The grid screen is connected to the reflector lamp 1 by means of the spring clips 10 in a force-fitting manner and the honeycomb grid disc 5 is connected to the component 4 by means of the upper and lower disc holders 6 in an interlocking manner.

According to FIG. 4, the disturbing lateral glare rays 12 generated by the light source 14 and emerging from underneath the cap 2 are absorbed by the honeycomb grid disc 5, while the reflected useful rays 15 pass through the honeycomb grid disc 5.

The grid screen is advantageous for the following reasons: (i) absorbs disturbing lateral glare; (ii) is in the form of, and available as, a compactly prefabricated retrofit part; (ii) can be mounted and dismounted easily; (iii) is connected to the reflector lamp 1 in a force-fitting manner such that a spacing from articles is additionally achieved by means of the projecting spring clips 10, and thus the risk of overheating given too small a spacing is reduced; (iv) and only one connection parameter sufficing in order to be fastened to the standardized reflector lamps in the prefabricated state. The compact grid screen is advantageously in the form of a light-weight unit on account of few components being used.

What is claimed is:

1. An assembly comprising:

a reflector lamp (1) comprising:

a reflector (13) having an outer rim (7);

a bridge (3) fixedly arranged on the reflector (13);

a cap (2) centrally disposed on the bridge (3);

a light source (14) an upper portion of which projects into the cap (2);

a grid screen secured onto the outer rim (7) of the reflector lamp (1), the grid screen comprising:

a peripheral component (4);

a honeycomb grid disc (5) secured to the peripheral component by spring clips (10) received in lower and upper disc holders (6) formed by the peripheral component (4), the honeycomb grid disc (5) having a central aperture (9) defined therein; the spring clips (10) having cranked clip ends (11), pass through the central aperture (9) of the honeycomb grid disc (5) and hook under the bridge (3) of the reflector lamp (1); the honeycomb grid disc (5) having keyhole-type cutouts (8) defined on both sides of the central aperture (9) so as to permit the bridge (3) to pass therethrough in a contactless manner; the honeycomb grid disc (5) being adapted to absorb glare rays (12) generated by the light source (14) and emerging from underneath the cap (2), while reflected useful rays (15) are passed through the honeycomb grid disc (5).

2. The assembly according to claim 1, wherein the spring clips (10) are fastened on the component (4) by spot-welding.

3. The assembly according to claim 1, wherein the spring clips (10) are flat steel spring clips.

4. A grid screen for an illumination device including a light source (14) an upper portion of which projects into a cap (2) with a bridge (3) securable to the cap (2), the grid screen comprising:

a peripheral component (4);

a honeycomb grid disc (5) secured to the peripheral component by spring clips (10) received in lower and upper disc holders (6) formed by the peripheral component (4), the honeycomb grid disc (5) having a central aperture (9) defined therein; the spring clips (10) having cranked clip ends (11), pass through the central aperture (9) of the honeycomb grid disc (5) and adapted to be securable under the bridge (3) of the illumination device; the honeycomb grid disc (5) having keyhole-type cutouts (8) defined on opposing sides of the central aperture (9) adapted so as to permit the bridge (3) of the illumination device to pass therethrough in a contactless manner; the honeycomb grid disc (5) being made of a material to absorb glare rays (12) generated by the light source (14) and emerging from underneath the cap (2), while reflected useful rays (15) are passed through the honeycomb grid disc(5).

5. The grid screen according to claim 4, wherein the spring clips (10) are fastened on the component (4) by spot-welding.

6. The grid screen according to claim 4, wherein the spring clips (10) are flat steel spring clips.

* * * * *